US009765739B2

(12) United States Patent
Kato

(10) Patent No.: US 9,765,739 B2
(45) Date of Patent: Sep. 19, 2017

(54) HIGH-PRESSURE FUEL PUMP

(71) Applicant: Toyota Jidosha Kabushiki Kaisha, Toyota-shi, Aichi-ken (JP)

(72) Inventor: Yoshikazu Kato, Nissin (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 281 days.

(21) Appl. No.: 14/505,886

(22) Filed: Oct. 3, 2014

(65) Prior Publication Data

US 2015/0098848 A1 Apr. 9, 2015

(30) Foreign Application Priority Data

Oct. 7, 2013 (JP) ..... 2013-210144

(51) Int. Cl.

| | |
|---|---|
| ***F04B 49/24*** | (2006.01) |
| ***F02M 59/36*** | (2006.01) |
| ***F02M 59/44*** | (2006.01) |
| ***F02M 59/46*** | (2006.01) |

(52) U.S. Cl.

CPC ..... *F02M 59/367* (2013.01); *F02M 59/447* (2013.01); *F02M 59/464* (2013.01); *F02M 2200/40* (2013.01)

(58) Field of Classification Search

CPC .. F02M 59/367; F02M 59/447; F02M 59/464; F02M 2200/40; F04B 49/24; F04B 49/243

See application file for complete search history.

(56) References Cited

U.S. PATENT DOCUMENTS

| | | | | |
|---|---|---|---|---|
| 6,631,706 | B1 | 10/2003 | Yamada et al. | |
| 7,819,637 | B2 * | 10/2010 | Oda | F02M 59/366 251/129.07 |
| 9,447,893 | B2 * | 9/2016 | Wirkowski | F02D 41/20 |
| 2013/0098338 | A1 * | 4/2013 | Usui | F02M 69/02 123/495 |
| 2014/0048043 | A1 * | 2/2014 | Roth | F02M 59/366 123/458 |

(Continued)

FOREIGN PATENT DOCUMENTS

| | | | |
|---|---|---|---|
| JP | H09303227 | A | 11/1997 |
| JP | 2009-203987 | A | 9/2009 |

(Continued)

*Primary Examiner* — Peter J Bertheaud
*Assistant Examiner* — Dnyanesh Kasture
(74) *Attorney, Agent, or Firm* — Dinsmore & Shohl LLP

(57) ABSTRACT

A high-pressure fuel pump includes a pump housing, a pressurizing member, a suction valve seat, a suction valve body, and a suction valve chamber. The suction valve seat includes a first projected wall section that is projected to an upper side in a vertical direction. The pump housing includes a second projected wall section that is directed to the upper side in the vertical direction. A height of the lowest position in a portion of the second projected wall section that is projected to the upper side in the vertical direction is higher than a height of the lowest position in a portion of the first projected wall section that is projected to the upper side in the vertical direction. A first initial fuel pool is provided on an downstream side of the second projected wall section and on the upstream side of the suction valve seat.

12 Claims, 8 Drawing Sheets

(56) References Cited

U.S. PATENT DOCUMENTS

| | | | | |
|---|---|---|---|---|
| 2014/0117268 | A1* | 5/2014 | Deponte | F02M 59/366<br>251/366 |

FOREIGN PATENT DOCUMENTS

| | | | | |
|---|---|---|---|---|
| JP | 2010-109104 | A | 5/2010 | |
| JP | 2010-190104 | A | 9/2010 | |
| JP | 2012-202381 | A | 10/2012 | |
| JP | 2013-036431 | A | 2/2013 | |
| WO | WO 2012116850 | A1 * | 9/2012 | F02M 59/366 |
| WO | WO 2012123130 | A1 * | 9/2012 | F02M 59/366 |
| WO | WO 2012150298 | A1 * | 11/2012 | F02D 41/20 |
| WO | 2013035132 | A1 | 3/2013 | |

* cited by examiner

HIGH-PRESSURE FUEL PUMP

INCORPORATION BY REFERENCE

The disclosure of Japanese Patent Application No. 2013-210144 filed on Oct. 7, 2013 including the specification, drawings and abstract is incorporated herein by reference in its entirety.

BACKGROUND OF THE INVENTION

1. Field of the Invention

The present invention relates to a high-pressure fuel pump and in particular to a high-pressure fuel pump that forms a fuel pool on a suction side in a fuel pressurizing chamber.

2. Description of Related Art

As a high-pressure pump that pressurizes fuel and discharges the pressurized fuel, that is, a high-pressure fuel pump, a fuel pump has been known that pressurizes fuel of an internal combustion engine for running a vehicle (hereinafter referred to as an engine) to a such a degree that the fuel can be injected into a cylinder.

Such a high-pressure fuel pump tends to form a fuel pool with a damper on an upstream side (a suction side) of a fuel pressurizing chamber in order to allow intermittent fuel suction by reciprocal movement of a plunger, or tends to communicate an auxiliary chamber whose volume varies by advancement/retraction of the plunger with the fuel pool.

For example, in a conventional high-pressure fuel pump, a fuel pool whose suction passage is extended and a fuel storage chamber with a pulsation damper that communicates with the fuel pool are arranged on an upstream side of a suction valve that is arranged on a radially outer side of a fuel pressurizing chamber (see Japanese Patent Application Publication No. 2012-202381 (JP 2012-202381 A), for example).

In addition, in another high-pressure fuel pump, in addition to a suction valve, a pump body is provided with an introduction check valve that allows introduction of fuel to an upstream side thereof, and a fuel storage chamber that stores the fuel introduced therein through the introduction check valve is disposed to ensure required fuel pressure of the fuel immediately before the fuel is suctioned by the suction valve (see Japanese Patent Application Publication No. 2013-036431 (JP 2013-036431 A), for example).

SUMMARY OF THE INVENTION

However, it has been concerned that pressurization failure occurs in the conventional high-pressure fuel pump as described above when the conventional high-pressure fuel pump is used in such a condition that an engine of a vehicle is temporarily stopped while being soaked with the fuel at a high temperature and is then restarted. Thus, parts and control are required as a measure against pressurization failure, and this leads a problem of increased cost of the high-pressure fuel pump and a high-pressure fuel supply system that uses the high-pressure fuel pump.

More specifically, in the conventional high-pressure fuel pump, a fuel supply passage from a feed pump is connected to a fuel pool with a relatively large capacity or to a fuel storage chamber with a pulsation damper, or is branched on an upstream side of a suction valve or a suction valve chamber that houses the suction valve.

Thus, when a high-temperature soak state is prolonged and a vaporized amount of the fuel in the fuel storage chamber is thereby increased, a time required to suction the fuel (a liquid) that is supplied upon restarting of the engine into a fuel pressurizing chamber is extended. As a result, responsiveness of the high-pressure fuel pump to pressurization and discharge upon starting of supply of high-pressure fuel is degraded, and this may cause the pressurization failure.

Meanwhile, in order to avoid such pressurization failure, there is a case where a heat insulating material has to be provided between the high-pressure fuel pump and a member on the engine side that supports the high-pressure fuel pump, where the fuel in a low-pressure fuel circuit that supplies the fuel to the high-pressure fuel pump has to be pressurized, or where an electric fan or the like for a purpose of cooling is necessary.

The present invention provides a low-cost high-pressure fuel pump with superior responsiveness that can immediately pressurize and discharge fuel even when supply of high-pressure fuel is started in a high-temperature environment such as a high-temperature soak state.

The high-pressure fuel pump according to one aspect of the present invention, the high-pressure fuel pump includes a pump housing, a pressurizing member, a suction valve seat, a suction valve body, and a suction valve chamber. The pump housing includes a fuel passage. The pressurizing member is operably supported by the pump housing, so as to define a fuel pressurizing chamber that communicates with the fuel passage in the pump housing. The pressurizing member is configured be displaced in a suction operation direction in which fuel is suctioned into the fuel pressurizing chamber and in a discharge operation direction in which the fuel in the fuel pressurizing chamber is discharged by power from the outside. The suction valve seat is provided on a suction side of the fuel pressurizing chamber within the fuel passage. The suction valve seat includes a first projected wall section that is projected to an upper side in a vertical direction. The suction valve body is configured to engage with and disengage from the suction valve seat, so as to switch between a valve opened state in which a suction operation of the fuel into the fuel pressurizing chamber is permitted and a valve closed state in which a backflow of the fuel from the fuel pressurizing chamber to the upstream side is prevented. The suction valve chamber houses the suction valve body on the suction side of the fuel pressurizing chamber within the fuel passage. The pump housing includes a second projected wall section that is projected to the upper side in the vertical direction and projected to the inside of the suction valve chamber. A height of the lowest position in a portion of the second projected wall section that is projected to the upper side in the vertical direction is higher than a height of the lowest position in a portion of the first projected wall section that is projected to the upper side in the vertical direction. A fuel introducing chamber is provided between the second projected wall section and the suction valve seat and adjacent to the upstream side of the suction valve seat. The fuel introducing chamber is configured to be directly introduced the fuel from outside of the pump housing. the fuel introducing chamber and the second projected wall section and the second projected wall section provide a first initial fuel pool that stores the fuel when the fuel from the outside is introduced into the fuel introducing chamber and the suction valve body is in the valve opened state. The first initial fuel pool is provided on a downstream side of the second projected wall section and on an upstream side of the suction valve seat.

According to the above configuration, when the fuel is introduced into the fuel introducing chamber with a small volume that is adjacent to the upstream side of the suction valve body, the first initial fuel pool is immediately provided on the downstream side of the second projected wall section and on the upstream side of the suction valve seat. Thus, when the suction valve is opened, the fuel that is immediately after being introduced into the fuel introducing chamber can easily flow into the fuel pressurizing chamber. Accordingly, even in a high-temperature environment such as a high-temperature soak state, liquid fuel in the fuel pressurizing chamber is immediately suctioned when supply of the high-pressure fuel is started, and consequently, responsiveness to pressurization and discharge is improved. In addition, since there is no need to provide a heat insulating material or a cooling part or to increase fuel pressure in a low-pressure fuel circuit, manufacturing cost of the high-pressure fuel pump and a high-pressure fuel supply system that uses the high-pressure fuel pump can be reduced. Here, to be adjacent to the upstream side of the suction valve body means to face a pressure receiving surface on the upstream side of the suction valve.

In the high-pressure fuel pump according to the one aspect of the present invention, the fuel passage and the suction valve seat may provide a second initial fuel pool that stores the fuel when the fuel from the outside is introduced into the fuel introducing chamber. The second initial fuel pool may be provided on the downstream side of the suction valve seat in a portion of the fuel passage on the suction side.

According to the above configuration, the fuel pool that is located on the downstream side of the second projected wall section and reaches the upstream side and the downstream side of the suction valve seat is formed by a first fuel pool and a second fuel pool. In addition, the fuel pool is positioned immediately before the suction port of the fuel pressurizing chamber. Thus, when the suction valve is opened, the fuel that is immediately after being introduced into the fuel introducing chamber can easily flow into the fuel pressurizing chamber.

In the high-pressure fuel pump according to the one aspect of the present invention, the fuel pressurizing chamber may include a suction port provided on the suction side of the fuel pressurizing chamber within the fuel passage. The suction port may be provided on the downstream side of the suction valve seat. A height of an opening inner circumferential surface of the suction port on the upper side in the vertical direction may be set between a projected height of the first projected wall section on the upper side in the vertical direction and a projected height of the second projected wall section on the upper side in the vertical direction. The height of the opening inner circumferential surface of the suction port on the upper side in the vertical direction may be closer to the projection height of the first projected wall section than the projection height of the second projected wall section.

According to the above configuration, when a liquid surface of the fuel in the fuel introducing chamber is elevated in the valve opened state of the suction valve, the fuel that is immediately after being introduced into the fuel introducing chamber is immediately pooled in the initial fuel pool on the upstream side and the downstream side of the suction valve seat. Then, even before the liquid surface height of the fuel exceeds a height of the second projected wall section, the fuel reliably flows into the fuel pressurizing chamber. The vertical direction herein means a vertical direction in an installed posture of the high-pressure fuel pump.

In the high-pressure fuel pump according to the one aspect of the present invention, the high-pressure fuel pump may be include an elastic member and a rod-shaped valve body. The elastic member may urge the suction valve body to one direction of the closing direction and opening direction. The elastic member may be housed in the suction valve chamber. The rod-shaped valve body operating member may urge the suction valve body to other direction. The rod-shaped valve body operating member may be housed in the suction valve chamber. The second projected wall section may be a flange that extends inwardly. The flange may surround a shaft portion of the rod-shaped valve body operating member on the suction valve body side.

According to the above configuration, a suction valve unit in which the suction valve, the elastic member, and the rod-shaped valve body operating member are arranged in the suction valve chamber can easily be configured, and the fuel introducing chamber can easily be formed in the suction valve unit.

In the high-pressure fuel pump according to the one aspect of the present invention, the suction valve chamber may include a cylindrical member that is fixed on the pump housing. The second projected wall section may partition the inside of the cylindrical member into an inner chamber section on one side that houses the suction valve body and an inner chamber side on another side. The fuel introducing chamber may be arranged on the inner chamber section on the one side.

According to the above configuration, a fuel introducing chamber with an extremely small volume that is adjacent to the upstream side of the suction valve body can be formed. Accordingly, the responsiveness to the pressurization and discharge of the high-pressure fuel pump when the supply of the high-pressure fuel is started in the high-temperature environment can further be improved.

In the high-pressure fuel pump according to the one aspect of the present invention, the pump housing may include a fuel storage chamber for storing the fuel. The cylindrical member may include a communication hole that communicates between the fuel storage chamber and the inner chamber section on the other side on the upper side in the vertical direction of the inner chamber section on the other side.

According to the above configuration, the liquid fuel that is introduced into the fuel introducing chamber is first filled in the fuel introducing chamber, and is then filled in the suction valve chamber. Thereafter, the fuel flows into the fuel storage chamber.

In the high-pressure fuel pump according to the one aspect of the present invention, the pump housing may include a cylinder member that slidably holds the pressurizing member and a holder member that holds the cylindrical member. The holder member may coaxially join the suction valve seat, a partition wall, and one end of the cylindrical member. The partition wall may include the second projected wall section.

According to the above configuration, the suction valve seat, the partition wall, and the one end of the cylindrical member can easily be joined to the holder member in this order, and the fuel introducing chamber can easily be defined by the joining.

The present invention provides a low-cost high-pressure fuel pump with superior responsiveness that can immediately pressurize and discharge fuel even when supply of high-pressure fuel is started in a high-temperature environment.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A description will hereinafter be made on a preferred embodiment of the present invention with reference to drawings.

Figure 1:
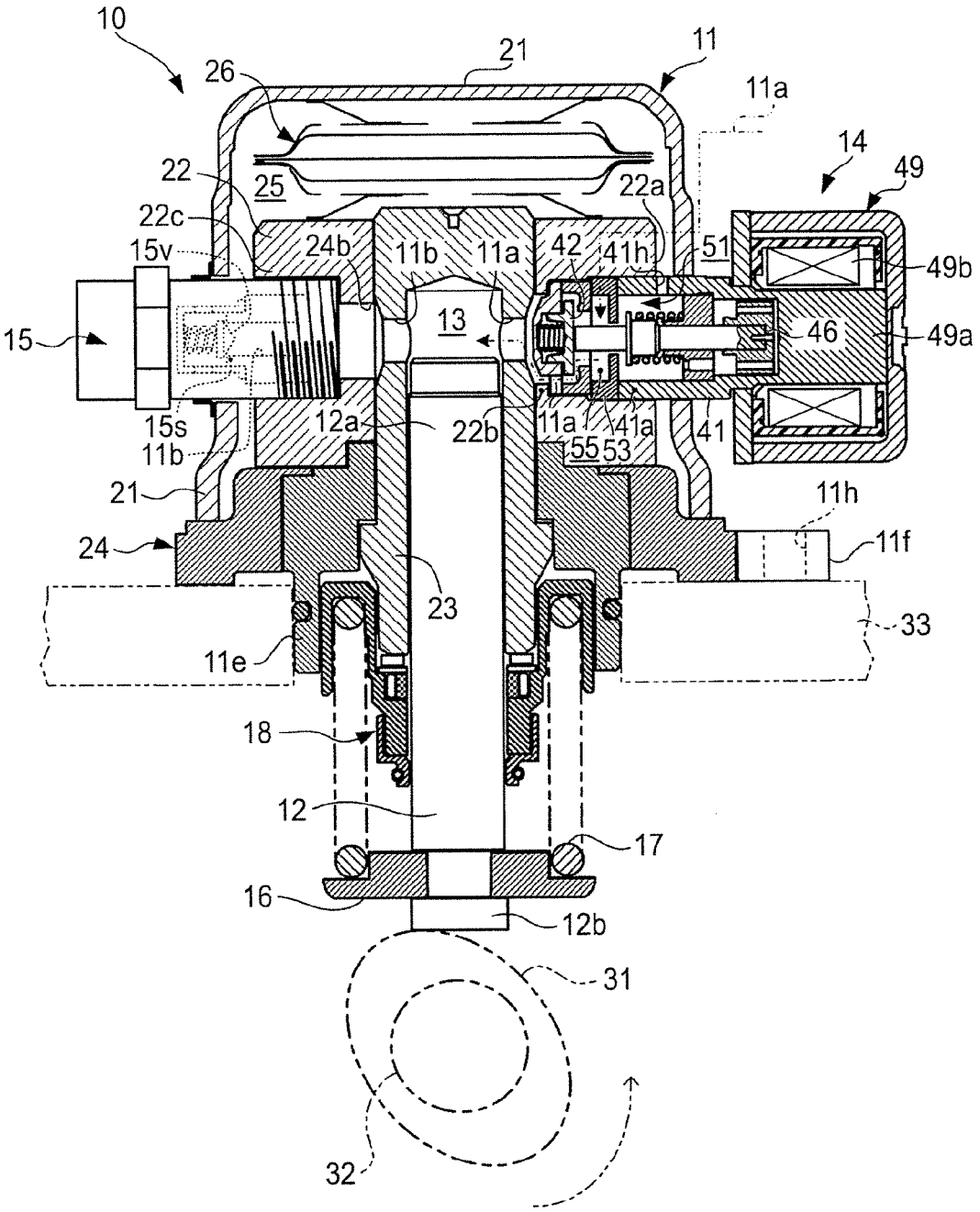
FIG. 1 is a cross-sectional view of a high-pressure fuel pump according to an embodiment of the present invention that is cut along the center of a cylinder.

(Embodiment) FIG. 1 is a schematic block diagram of a configuration of a high-pressure fuel pump according to the embodiment of the present invention, First, the configuration will be described.

Figure 2:
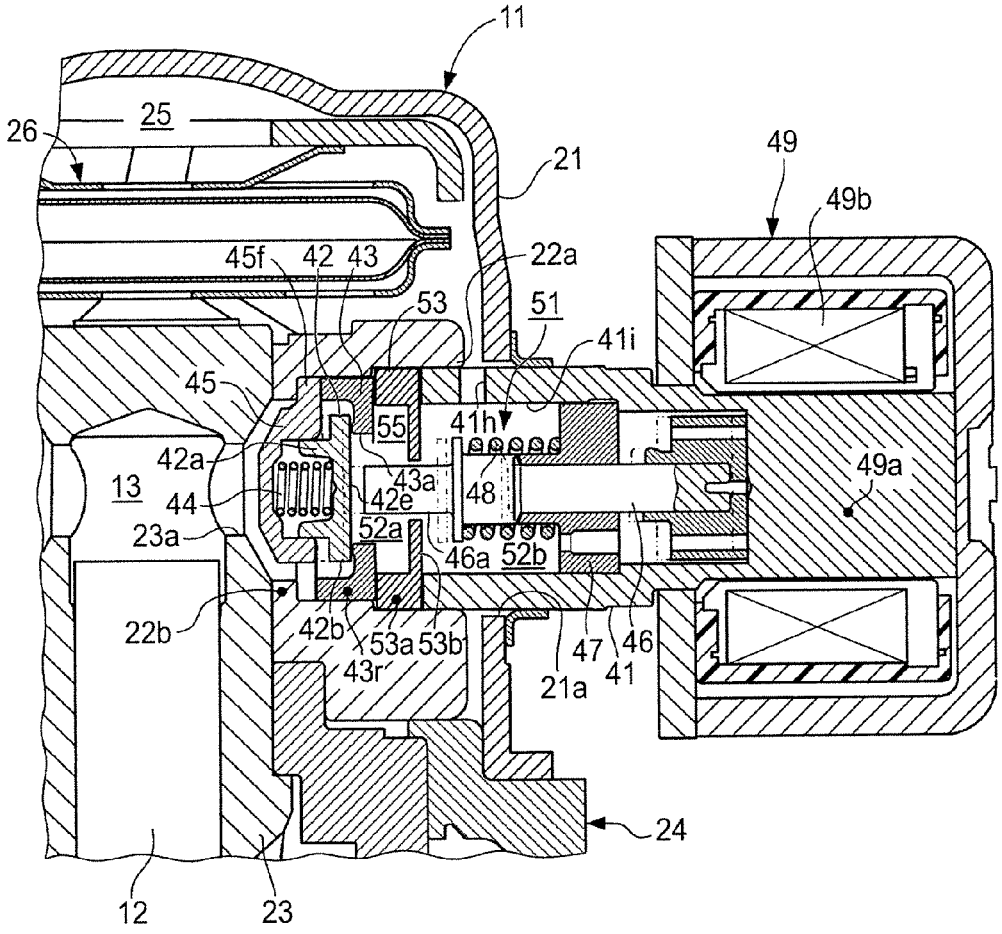
FIG. 2 is a partially enlarged cross-sectional view of the vicinity of a suction valve in the high-pressure fuel pump according to the embodiment of the present invention.
Figure 3:
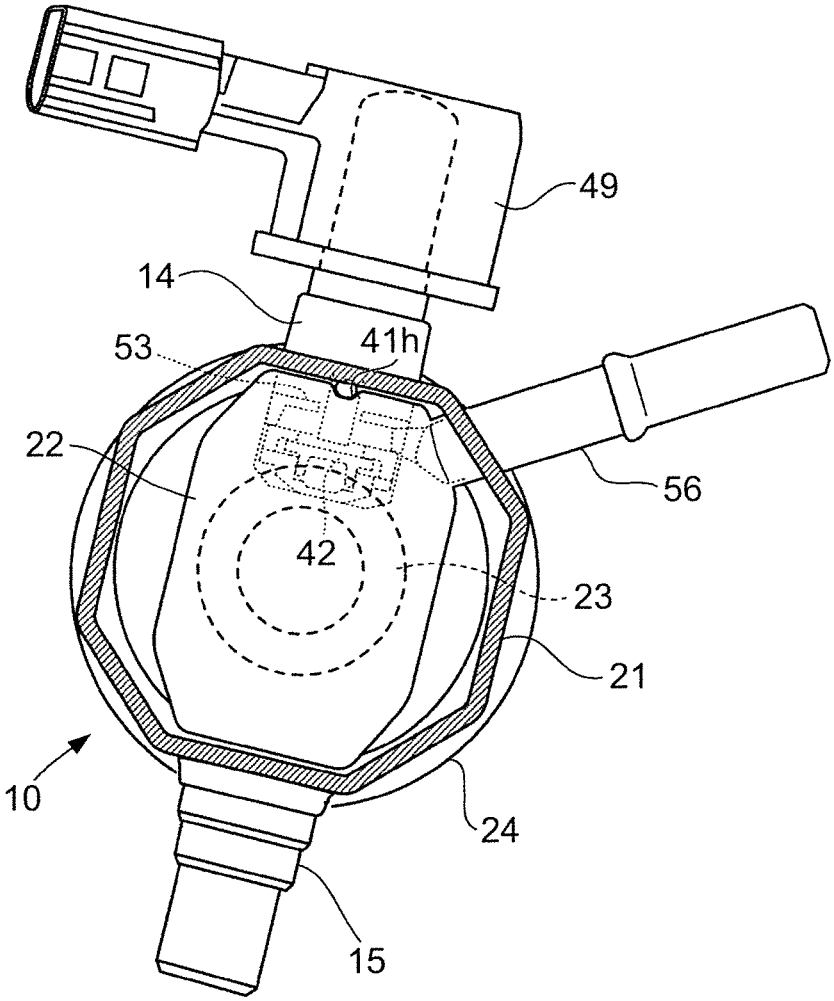
FIG. 3 is a planar cross-sectional view in which an outer shell cover section is cut on an upper end side of a cylinder in the high-pressure fuel pump according to the embodiment of the present invention.

FIG. 1 to FIG. 3 show the configuration of the high-pressure fuel pump according to the embodiment of the present invention.

A high-pressure fuel pump 10 of this embodiment is installed in an internal combustion engine that is mounted in a vehicle, for example, a multi-cylinder gasoline engine of cylinder injection type or dual injection type (hereinafter simply referred to as an engine), and is of plunger pump type that pressurizes fuel of the engine to high pressure and discharge the pressurized fuel. Needless to say, the high-pressure fuel pump of the present invention can be applied to an engine other than the gasoline engine that uses fuel with relatively high volatility.

The high-pressure fuel pump 10 of this embodiment shown in FIG. 1 is connected by a pipe on a suction side thereof to a low-pressure fuel circuit (not shown), to which fuel is supplied from a low-pressure fuel pump. The high-pressure fuel pump 10 suctions the fuel that is pumped from a fuel tank by the low-pressure fuel pump and pressurized to feed pressure. The low-pressure fuel pump is configured by including a circumferential flow pump or the like in which a pump impeller is rotationally driven by an electric motor, for example.

In addition, the high-pressure fuel pump 10 is connected by a pipe on a discharge side thereof to plural injectors for cylinder injection (direct cylinder injection of fuel) via a high-pressure delivery pipe, and pressure-feeds the high-pressure fuel to the delivery pipe. The delivery pipe stores and accumulates the high-pressure fuel that is discharged from the high-pressure fuel pump 10, and distributes and supplies the high-pressure fuel to the injectors when a valve in each of the injectors for the cylinder injection of the engine is opened.

As shown in FIG. 1, the high-pressure fuel pump 10 has a pump housing 11, a substantially cylindrical plunger 12 (a pressurizing member) that is provided in a manner capable of reciprocal displacement in an axial direction with respect to the pump housing 11, a suction valve unit 14 (a suction valve) that is attached to the pump housing 11 on a same axis so as to axially cross the pump housing 11, and a discharge valve unit 15.

The pump housing 11 is formed with a suction passage 11*a* (a fuel passage on a suction side) that suctions the fuel from a feed pump (the low-pressure fuel pump) and a discharge passage 11*b* (a fuel passage on a discharge side) that discharges the fuel that has been pressurized in the pump housing 11 to the delivery pipe side.

An inner end 12*a* of the plunger 12 on an upper side in FIG. 1 (an upper end in FIG. 1) is slidably inserted in the pump housing 11, and an outer end 12*b* thereof on a lower side in FIG. 1 is engaged with a drive cam 31 (may be a locker arm or the like).

The drive cam 31 is a known drive cam with a cam profile whose radius (a lift amount) is larger in at least one portion in a circumferential direction than another portion (a cam profile of an ellipse or a polygon whose corners are rounded). This drive cam is integrally attached to an exhaust camshaft 32 of the engine, for example, and driven by power of the engine.

A fuel pressurizing chamber 13 that is connected to the suction passage 11*a* and the discharge passage 11*b* is defined in the pump housing 11, in which the plunger 12 is inserted.

This fuel pressurizing chamber 13 changes its volume in accordance with axial displacement of the plunger 12, and thus can suction and discharge the fuel. More specifically, when the plunger 12 is displaced downward in FIG. 1 (in a suction operation direction), the fuel pressurizing chamber 13 increases its volume to suction the fuel. On the other hand, when the plunger 12 is displaced upward in FIG. 1 (in a discharge operation direction), the fuel pressurizing chamber 13 reduces its volume to discharge the fuel.

On the suction passage 11*a* of the pump housing 11, the suction valve unit 14 has a check valve function that allows suction of the fuel into the fuel pressurizing chamber 13 while preventing a backflow of the fuel from the fuel pressurizing chamber 13 to the upstream side.

The discharge valve unit 15 is screwed to an attachment hole 22*c* on the discharge side of an upper housing member 22, for example. On the discharge passage 11*b* of the pump housing 11, this discharge valve unit 15 has a check valve function that allows discharge of the fuel from the fuel pressurizing chamber 13 while preventing the backflow of the fuel from a downstream side to the fuel pressurizing chamber 13.

A proximal end side of the pump housing 11 is provided with plural flange sections 11*f* (only one of them is shown in FIG. 1), each of which is formed with a bolt hole 11*h*, and a fitted section 11*e* that is fitted in a pump attachment section 33 of a head cover or the like of the engine. Then, the pump housing 11 is fastened to the head cover or the like that constitutes the pump attachment section 33 by plural bolts (not shown) that are inserted in the plural bolt holes 11*h*.

A spring receiving section 16 is attached to the vicinity of the outer end 12*b* of the plunger 12, and a compression coil spring 17 and a seal unit 18 are interposed between this the spring receiving section 16 and the pump housing 11.

the compression coil spring 17 urges the plunger 12 to a side that approaches the drive cam 31, and the plunger 12 is constantly urged in a direction to increase the volume of the fuel pressurizing chamber 13 (downward in FIG. 1) by the compression coil spring 17. Thus, when the drive cam is rotationally driven, the plunger 12 is reciprocally displaced in the axial direction in accordance with rotation of the drive cam.

In addition, the pump housing 11 is configured by including: an outer shell member 21 in a cup shape, that is, in a bottomed cylindrical shape that the suction valve unit 14 and the discharge valve unit 15 penetrate in a horizontal direction in FIG. 1; the upper housing member 22 (a holder member) that is housed on the inside of the outer shell member 21; a cylinder member 23 that is inserted in and held by the center of the upper housing member 22; and a lower housing member 24 that has the fitted section 11*e*, the attachment flange section 11*f*, and the like and that closes an open end of the outer shell member 21, together with the cylinder member 23.

These upper housing member 22, the cylinder member 23, and the lower housing member 24 are integrally joined in a state that the cylinder member 23 is fitted to and held by the center of the upper housing member 22 and the center of the lower housing member 24, and a lower end of the outer shell member 21 is fixed to the lower housing member 24. Here, an arbitrary joining method such as press-fitting, soldering, screwing, or the like can be adopted as a method of fixing the outer shell member 21 to the lower housing member 24 and a method of joining the cylinder member 23 to the upper housing member 22 and the lower housing member 24.

A fuel storage chamber 25 is formed at a position that is the inside of the pump housing 11 and a circumference of the upper housing member 22, for example, at a position on an outer circumferential side and an upper surface side of the upper housing member 22 in FIG. 1.

This fuel storage chamber 25 is a fuel pool with a specified volume that is connected to and communicated with the suction passage 11*a*, and fuel on a low pressure side is stored. In addition, the fuel storage chamber 25 has a volume that is relatively large enough to house a pulsation damper 26 (fuel pressure pulsation damping element), and fluctuation of fuel pressure in the suction passage 11*a* that is caused by intermittent suction of the fuel into the fuel pressurizing chamber 13 or the like can be absorbed by the pulsation damper 26 therein.

The suction valve unit 14 includes a cylindrical member 41 that forms a part of the suction passage 11*a* as well as a suction valve body 42, a suction valve seat 43, a valve spring 44, and a spring receiver 45 that are housed in an attachment hole 22*a* of the upper housing member 22 and in front of the cylindrical member 41.

An end of the cylindrical member 41 in the axial direction is fitted in or screwed to the attachment hole 22*a* on the suction side of the upper housing member 22, and the center thereof in the axial direction penetrates a through hole 21*a* of the outer shell member 21.

The suction valve body 42 has a sliding section 42*a* that is slidably guided into the spring receiver 45 on the downstream side in a fuel suction direction and a valve body section 42*b* in a substantially disc shape that is urged by the valve spring 44 (one urging member) to a valve closed side so as to abut against the suction valve seat 43 on the upstream side.

Of the suction passage 11*a* and the discharge passage 11*b*, on the suction passage 11*a* on the suction side of the fuel pressurizing chamber 13, this suction valve body 42 can be displaced to a valve opened position at which the suction of the fuel into the fuel pressurizing chamber 13 is allowed (a position of the valve body in FIG. 1) and a valve closed position at which the suction of the fuel into the fuel pressurizing chamber 13 is restricted (a position of the valve body that is indicated by a solid line in FIG. 2).

The suction valve seat 43 is in an annular shape, and the valve body section 42*b* of the suction valve body 42 can be engaged and disengaged on one surface side thereof. The suction valve seat 43 forms a part of the suction passage 11*a* while constituting a first projected wall section by an inner circumference annular section 43*a*, the first projected wall section is at least projected upward in a vertical direction in the suction passage 11*a*. An outer circumference annular section 43*r* of the suction valve seat 43 is engaged with the attachment hole 22*a* on the suction side of the upper housing member 22.

The valve spring 44 is configured by a compression coil spring that is interposed between the valve body section 42*b* of the suction valve body 42 and the spring receiver 45.

The spring receiver 45 has a circular recessed shape at the center on one surface side to hold the sliding section 42*a* of the suction valve body 42, and has a flange section 45*f* on an outer circumferential side that is formed by notching a portion (or may be plural portions) thereof in the circumferential direction. This flange section 45*f* of the spring receiver 45 abuts against an abutment section 22*b* on an inner back side of the attachment hole 22*a* of the upper housing member 22, and the most downstream section of the suction passage 11*a* that is adjacent to the fuel pressurizing chamber 13 is formed by a notched portion that is formed with the flange section 45*f*.

A solenoid plunger 46 (another urging member), a guide member 47, and a compression coil spring 48 are further housed in the cylindrical member 41, and a solenoid unit 49 is attached to an outer end side of the cylindrical member 41.

The solenoid plunger 46 serves as a rod-shaped valve body operating member that can urge the suction valve body 42 to a valve opened side that is separated from the suction valve seat 43 for operation by resisting against an urging force of the valve spring 44.

The guide member 47 guides the solenoid plunger 46 in a slidable manner in the axial direction within the cylindrical member 41, and the compression coil spring 48 is interposed between the solenoid plunger 46 and the guide member 47 so as to urge the suction valve body 42 to the valve opened side via the solenoid plunger 46.

The solenoid unit 49 has a fixed iron core section 49*a* that opposes one end side of the solenoid plunger 46 and an electromagnetic coil 49*b* that is arranged around the fixed iron core section 49*a*. When the electromagnetic coil 49*b* is excited by energization, the solenoid unit 49 suctions and displaces the solenoid plunger 46 in a valve closed direction of the suction valve body 42 against the urging force of the compression coil spring 48 so as to displace the solenoid plunger 46.

Thus, when the solenoid unit 49 is turned into an excited state (hereinafter also referred to as an ON state) by the energization, the solenoid plunger 46 is detached from the suction valve body 42. Therefore, the suction valve body 42 serves as a check valve that is operated in accordance with the urging force of the valve spring 44 and the urging force that is based on a differential pressure between the front and the rear.

On the other hand, when the solenoid unit 49 is not energized and thus is turned into a non-excited state (hereinafter also referred to as an OFF state), the solenoid plunger 46 causes the suction valve body 42 to be detached from the suction valve seat 43 by the urging force of the compression coil spring 48. Thus, in this OFF state, the suction valve unit 14 is constantly held in an valve opened state. Accordingly, a leaked state is established in which, even when the plunger 12 is displaced in a pressurizing direction, the fuel in the fuel pressurizing chamber 13 is leaked to the suction passage 11*a* and thus is not pressurized. Here, the suction valve unit 14 is of constantly opened type. However, needless to say, the suction valve unit 14 may be of constantly closed type.

A discharge valve seat 15s that forms a part of the discharge passage 11*b* is formed on the inside of the discharge valve unit 15, and a discharge valve body 15*v* with a check valve function and a valve spring 15*k* that constantly urges this discharge valve body 15*v* in the valve closed direction are housed on the inside of the discharge valve unit 15. When differential pressure between the front and the rear of the discharge valve body 15*v*, the fuel pressurizing chamber 13 side of which becomes at high pressure, reaches a specified value or higher, the discharge valve unit 15 displaces the discharge valve body 15*v* in a valve opened direction, so as to discharge the fuel from the fuel pressurizing chamber 13. On the other hand, when the differential pressure between the front and the rear of the discharge valve body 15*v*, the fuel pressurizing chamber 13 side of which becomes at high pressure, does not reach the specified value or higher, the discharge valve unit 15, the discharge valve body 15*v* returns to a valve closed state by an urging force of the valve spring 15*k*.

In the high-pressure fuel pump 10 of this embodiment that is configured as above, when the plunger 12 receives drive power in the pressurizing direction, which is against a returning force of the compression coil spring 17, from the drive cam 31, a suction operation in which the suction valve unit 14 is turned into a valve opened state in the valve closed state of the discharge valve unit 15 and a discharge operation in which the fuel in the fuel pressurizing chamber 13 is pressurized and the discharge valve unit 15 is opened in a valve closed state of the suction valve unit 14 are carried out.

In the high-pressure fuel pump 10 of this embodiment, a suction valve chamber 51 that at least houses the suction valve body 42, the suction valve seat 43, and the valve spring 44 is defined on the inside of the cylindrical member 41 of the suction valve unit 14 and the attachment hole 22*a* of the upper housing member 22, which is an attachment section of the cylindrical member 41 (both of these components are hereinafter referred to as the cylindrical member 41 and the like).

In addition, a partition wall member 53 is provided on the inside of the cylindrical member 41 and the like. The suction valve chamber 51 is divided by this partition wall member 53 into an inner chamber section 52*a* on one side near the suction valve body 42 and an inner chamber section 52*b* on another side that is separated from the suction valve body 42.

Here, the inner chamber section 52*a* on the one side is defined on the inside of the cylindrical member 41 of the suction valve unit 14 and between the spring receiver 45 and the partition wall member 53. The suction valve body 42, the suction valve seat 43, the valve spring 44, and the like are arranged in this inner chamber section 52*a* on the one side.

In the inner chamber section 52*b* on the other side, the solenoid plunger 46 is housed in a manner to urge the suction valve body 42 to another side of a valve opened/closed direction, for example, the valve opened direction.

The partition wall member 53 has: a cylindrical section 53*a* (a cylindrical member) whose radius is substantially the same as a radius of the cylindrical member 41 that is fitted in the attachment hole 22*a* of the upper housing member 22; and an inside flange shaped portion 53*b* and defines an opening. The inside flange shaped portion 53*b* is projected from the cylindrical section 53*a* or an inner circumferential wall surface 41*i* of the cylindrical member 41, so as to surround a shaft portion 46*a* on the suction valve body 42 side of the solenoid plunger 46.

Here, the cylindrical section 53*a* of the partition wall member 53 is fitted in from the right side in FIG. 2 toward the inner back side of the attachment hole 22*a* on the suction side of the upper housing member 22, and is then brought into press-contact with the cylindrical member 41 of the suction valve unit 14 from a rear side thereof. Then, on the inner back side of the attachment hole 22*a* on the suction side of the upper housing member 22, the cylindrical section 53*a* of this partition wall member 53 brings the flange sections 45*f* of the spring receiver 45 into press-contact with the abutment section 22*b* of the upper housing member 22 via the outer circumference annular section 43*r* of the suction valve seat 43.

In addition, each of the suction valve seat 43, the spring receiver 45, and the partition wall member 53 and one end 41*a* of the cylindrical member 41 that is joined to the inside of the attachment hole 22*a* on the suction side of the upper housing member 22 are coaxially joined to each other via the attachment hole 22*a* on the suction side of the upper housing member 22.

Meanwhile, the inside flange shaped portion 53*b* of the partition wall member 53 serves as a second projected wall section in an annular plate shape that is located on the inside of the cylindrical member 41 and the like and is projected to the inside of the suction valve chamber 51. A height hp of a projected end of the inside flange shaped portion 53*b* of the partition wall member 53 in a particular direction that is headed upward in the vertical direction from an inner bottom wall surface of the suction valve chamber 51 is higher than a height hs of the projected end of the suction valve seat 43 in the particular direction (a height at the lowest point in the inner circumference of the inner circumference annular section 43*a*). In other words, the height hp at the lowest position in an inner circumferential surface of a portion of the inside flange shaped portion 53*b* of the partition wall member 53 that is projected upward in the vertical direction is higher than the height hs at the lowest position in an inner circumferential surface of a portion of the inner circumference annular section 43*a* of the suction valve seat 43 that is projected upward in the vertical direction.

Here, the inside flange shaped portion 53*b* of the partition wall member 53 is projected to the inside of the suction valve chamber 51 on a whole circumference of the cylindrical section 53*a* or on a whole circumference of the inner circumferential wall surface 41*i* of the cylindrical member 41. However, the projected wall section of the present invention may only have to be projected in the particular direction at least from a lower side portion of the cylindrical section 53*a* or the inner circumferential wall surface 41*i* of the cylindrical member 41 in the vertical direction and to form an initial fuel pool 57*b*, which will be described below, on the upstream side of the suction valve body 42 and the suction valve seat 43.

A fuel introducing chamber 55 is formed on the inside of the suction valve chamber 51 and between the partition wall member 53 and a combination of the suction valve body 42 and the suction valve seat 43. The fuel introducing chamber 55 is directly connected to the inside of an inlet pipe 56 (a fuel supply passage from the outside of the housing) in the vicinity of the inner chamber section 52*a* on the one side of the suction valve chamber 51, and directly introduces the fuel that is supplied from the low-pressure fuel pump through the inlet pipe 56 (see FIG. 3).

This fuel introducing chamber 55 is arranged on the inside of the inner chamber section 52*a* on the one side that houses the suction valve body 42 and the valve spring 44, and is adjacent to the upstream side of the suction valve seat 43 so as to face a pressure receiving surface 42*e* on the upstream side of the suction valve body 42. In addition, the fuel introducing chamber 55 has a significantly smaller volume than the fuel storage chamber 25, and also has a smaller volume than the inner chamber section 52*b* on the other side.

Figure 4:
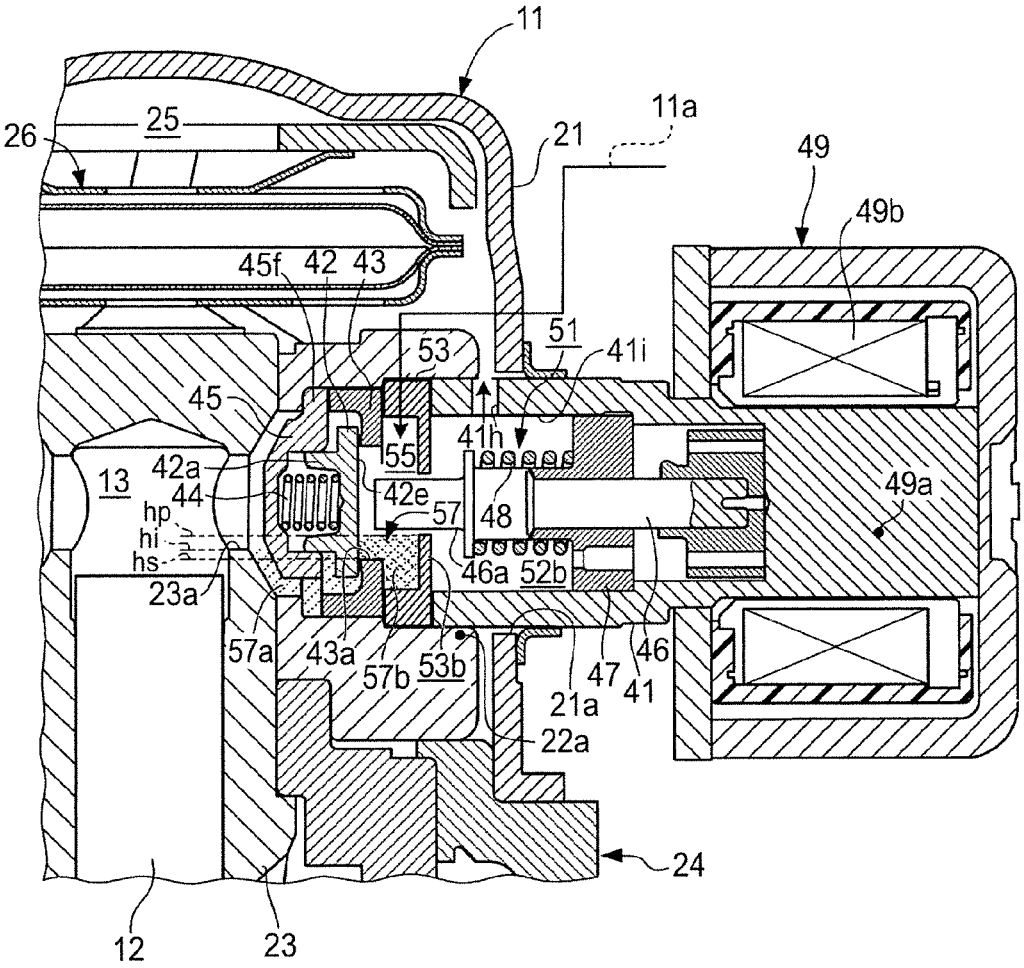
FIG. 4 is a partially enlarged cross-sectional view of the vicinity of the suction valve that illustrates an operation of the high-pressure fuel pump according to the embodiment of the present invention.

Furthermore, as shown in FIG. 4, on the downstream side of the inside flange shaped portion 53*b* in the suction passage 11*a*, an initial fuel pool 57 is formed that has a groove shape in which an inner bottom surface has a circular recessed shape, that is blocked by the cylinder member 23 at an entry of the fuel pressurizing chamber 13, and that is blocked by the inside flange shaped portion 53*b* of the partition wall member 53 in the vicinity of the suction valve seat 43.

This initial fuel pool 57 includes the first initial fuel pool 57*b* that can store the fuel on the downstream side of the inside flange shaped portion 53*b* of the partition wall member 53 and also on the upstream side the suction valve body 42 and the suction valve seat 43 even when the suction valve body 42 is in the valve closed state in a case where the fuel from the outside is introduced into the fuel introducing chamber 55.

In addition, the initial fuel pool 57 further includes a second initial fuel pool 57*a* that can store the fuel on the downstream side of the inside flange shaped portion 53*b* in the suction passage 11*a* and also on the downstream side of the suction valve seat 43 when the suction valve body 42 is mainly in the valve opened state and the fuel from the outside is introduced into the fuel introducing chamber 55.

The height hs of the portion of the inner circumference annular section 43*a* in the suction valve seat 43 that is projected upward in the vertical direction and the height hp of the portion of the inside flange shaped portion 53*b* in the partition wall member 53 that is projected upward in the vertical direction are set so that the first initial fuel pool 57*b* and the second initial fuel pool 57*a* just as described are formed.

In other words, in this embodiment, when the fuel from the outside is introduced into the fuel introducing chamber 55, the initial fuel pools 57*a*, 57*b* are formed that can store the fuel on the downstream side of the inside flange shaped portion 53*b* of the partition wall member 53 in the suction passage 11*a* and also respectively on the downstream side and the upstream side of the suction valve seat 43.

More specifically, when a liquid surface height on the downstream side of the inside flange shaped portion 53*b* of the partition wall member 53 is higher than the projected height hs of the suction valve seat 43, the first initial fuel pool 57*b* and the second initial fuel pool 57*a* that can store the fuel can be formed on the downstream side of the inside flange shaped portion 53*b* of the partition wall member 53 in the suction passage 11*a* and also respectively on the upstream side and the downstream side of the suction valve seat 43. Then, when the fuel from the outside is introduced into the fuel introducing chamber 55, the liquid surface height on the downstream side of the inside flange shaped portion 53*b* of the partition wall member 53 is further increased, the initial fuel pool 57 in which the initial fuel pools 57*a*, 57*b* are integrated is formed.

In addition, when the fuel from the outside is introduced into the fuel introducing chamber 55 in the valve closed state of the suction valve unit 14 for a resupply of the high-pressure fuel to the engine (for example, when the suction valve unit 14 is of constantly closed type and the initial fuel is introduced), first, the initial fuel pool 57*b* whose liquid surface height is higher than the projected height hs of the suction valve seat 43 is formed on the upstream side of the suction valve body 42. Then, once the suction valve unit 14 is opened, the fuel immediately after the introduction also flows into the downstream side of the suction valve seat 43, and the initial fuel pool 57*a* is thereby formed (a dotted-line hatching portion in FIG. 4). When the liquid surface height on the downstream side of the inside flange shaped portion 53*b* of the partition wall member 53 is further increased, the initial fuel pool 57 in which the initial fuel pools 57*a*, 57*b* are integrated is formed immediately before a suction port of the fuel pressurizing chamber 13.

In the valve opened state of the suction valve unit 14 in which the suction valve body 42 and the suction valve seat 43 are separated, this initial fuel pool 57 can store the fuel up to the projected height hp of the inside flange shaped portion 53*b* that is the liquid surface height on the upper side in the vertical direction than a height hi in the vertical direction of a suction port inner circumferential surface 23*a* of the cylinder member 23 that forms the suction port of the fuel pressurizing chamber 13 (a height at the lowest point of the suction port inner circumferential surface 23*a*).

That is, in order to allow formation of such an initial fuel pool 57, the height hp in the vertical direction of the inside flange shaped portion 53*b* of the partition wall member 53 in the particular direction and the projected height hs of the suction valve seat 43 in the same direction are set to be high and low with respect to each other. In addition, in order to allow the prompt suction of the fuel into the fuel pressurizing chamber 13 upon opening of the suction valve unit 14, the projected height hs of the suction valve seat 43 is set to be approximately as high as the height hi in the particular direction of the suction port inner circumferential surface 23*a* of the cylinder member 23.

Here, the height hi in the particular direction of the suction port inner circumferential surface 23*a* of the cylinder member 23 is set between the projected height hs in the particular direction of the suction valve seat 43 and the projected height hp in the particular direction of the inside flange shaped portion 53*b* of the partition wall member 53 and on the projected height hs side in the particular direction of the suction valve seat 43. However, the projected height hs in the particular direction of the suction valve seat 43 may be set to be the same as or slightly higher than the height hi in the particular direction of the suction port inner circumferential surface 23*a* of the cylinder member 23.

Meanwhile, the fuel storage chamber 25 that is connected to the suction passage 11*a* communicates with the inner chamber section 52*b* on the other side of the suction valve chamber 51 through a communication hole 41*h* that is formed to penetrate upward in the vertical direction in the vicinity of the center in the axial direction of the cylindrical member 41.

Thus, when the fuel is directly introduced from the feed pump side into the fuel introducing chamber 55 through the inlet pipe 56, the fuel is filled in the fuel introducing chamber 55 while contacting the suction valve body 42. However, the fuel immediately after the introduction does not reach the inner chamber section 52*b* on the other side of the fuel introducing chamber 55 and the fuel storage chamber 25 that is connected via the communication hole 41*h* on the upper side in the vertical direction.

As described above, in this embodiment, on the inner circumferential side of the attachment hole 22*a* of the upper housing member 22 or on the inner circumferential side of the cylindrical member 41, and in the most upstream portion of the suction passage 11*a* that is located immediately after the inlet pipe 56, the fuel introducing chamber 55 whose volume is smaller than the fuel storage chamber 25 is arranged and formed to face the pressure receiving surface 42*e* on the upstream side of the suction valve body 42. Then, when the fuel is introduced into the fuel introducing chamber 55 with the small volume that is adjacent to the upstream side of the suction valve body 42, a liquid surface of the fuel in the fuel introducing chamber 55 that contacts the suction valve body 42 is immediately elevated. Furthermore, when the liquid surface of the fuel in the fuel introducing chamber 55 is elevated in the valve opened state of the suction valve unit 14, the fuel from the fuel introducing chamber 55 is immediately stored in the initial fuel pool 57, and the fuel flows into the fuel pressurizing chamber 13.

Meanwhile, the fuel introducing chamber 55 and the fuel storage chamber 25 are communicated with each other via the inner chamber section 52*b* on the other side and the communication hole 41*h*. In addition, the communication hole 41*h* that allows the inner chamber section 52*b* on the other side of the suction valve chamber 51 to communicate with the fuel storage chamber 25 is formed on the upper side in the vertical direction of the projected height hs in the particular direction of the suction valve seat 43. Furthermore, since the inside flange shaped portion 53*b* of the partition wall member 53 is projected by a specified projected height that corresponds to the set liquid surface height hp in a whole circumferential range of the inner circumferential wall surface of the cylindrical member 41, the inside flange shaped portion 53*b* reaches the lower side in the vertical direction of the communication hole 41*h* by the projected height, and divides the fuel introducing chamber 55 and the inner chamber section 52*b* on the other side.

Here, the suction valve unit 14 and the discharge valve unit 15 may be screwed to the upper housing member 22, may be joined integrally by another joining method, or may be formed integrally as a single component. In this case, the cylindrical member of the present invention becomes a member in which the attachment hole 22*a* of the upper housing member 22, the cylindrical section 53*a* of the partition wall member 53, and the cylindrical member 41 are integrated.

Next, a description will be made on operations.

In the high-pressure fuel pump 10 of this embodiment that is configured as described above and a fuel supply system that includes the high-pressure fuel pump 10, the outer end 12*b* of the plunger 12 is reciprocally driven by the rotation of the drive cam 31 in the engine and the returning force of the compression coil spring 17 in the state that the pump housing 11 is attached to the engine.

Accordingly, the high-pressure fuel pump 10, particularly, the lower end side of the pump housing 11 therein that is fixed to the engine receives heat by heat conduction from the engine, heat conduction of heat that is generated in conjunction with drive input from the drive cam 31 to the plunger 12, heat transmission from lubrication and cooling oils in the engine, each of which reaches a much higher temperature than the fuel, and the like.

In addition, in a high-temperature soak state in which the engine is stopped at a high temperature and the engine remains at the high temperature due to stop of cooling, for example, not only the lower end of the pump housing 11 but the inside of the attachment hole 22*a* of the upper housing member 22 and the inside of the fuel storage chamber 25 also reach a high temperature.

Furthermore, even in a case where a temperature of an area surrounding the fuel pump 10 becomes high in a state that the fuel is stagnated in the fuel pump 10 due to fuel cut of the engine or stop of high-pressure fuel injection, the inside of the pump housing 11 can reach a high temperature.

In such a state, since the fuel in the high-pressure fuel pump 10 is at a high temperature and a lower fuel pressure than the feed pressure, the fuel is likely to be vaporized, and fuel vapor is produced in the fuel storage chamber 25 with a relatively large volume and the like.

However, in the high-pressure fuel pump 10 of this embodiment that is configured as described above, when pressure-feeding and supply of the fuel from the feed pump are started due to restart of the engine or the like, first, the fuel that is directly introduced into the fuel introducing chamber 55 with a small volume through the inlet pipe 56 contacts the pressure receiving surface 42*e* of the suction valve body 42 on the upstream side, and the liquid surface is immediately elevated in the fuel introducing chamber 55.

Upon the valve opening that the suction valve body 42 separates from the suction valve seat 43, the fuel that is at a relatively low temperature immediately after being introduced into the fuel introducing chamber 55 reaches a liquid surface that is higher than the projected height in the particular direction of the suction valve seat 43 (hereinafter simply referred to as the projected height) hs while flowing to the fuel pressurizing chamber 13 side of the suction valve seat 43.

Accordingly, upon the valve opening that the suction valve body 42 separates from the suction valve seat 43, the fuel from the fuel introducing chamber 55 is immediately pooled in the initial fuel pool 57. Thus, before the pooled fuel passes the inside flange shaped portion 53*b* of the partition wall member 53 (before the liquid surface height of the fuel becomes equal to or higher than the projected height hp), the fuel that is immediately after being introduced from the outside reliably flows into the fuel pressurizing chamber 13.

Especially, the height hi in the particular direction of the suction port inner circumferential surface 23*a* of the cylinder member 23 is set between the projected height hs of the suction valve seat 43 and the projected height hp of the inside flange shaped portion 53*b* of the partition wall member 53 and to the projected height hs side of the suction valve seat 43. Thus, when the liquid surface of the fuel in the fuel introducing chamber 55 is elevated in the valve opened state of the suction valve unit 14, the fuel that is immediately after being introduced into the fuel introducing chamber 55 is immediately pooled in the initial fuel pools 57*a*, 57*b* that are respectively on the downstream side and the upstream side of the suction valve seat 43. Accordingly, even before the fuel in the fuel introducing chamber 55 reaches the liquid surface height that is higher than the inside flange shaped portion 53*b*, the fuel easily and reliably flows into the pressurizing chamber 13 via the initial fuel pool 57*a*.

In addition, as a portion of the inner chamber section 52*a* that is on the one side near the suction valve body 42, the fuel introducing chamber 55 faces the pressure receiving surface 42*e* of the suction valve body 42 on the upstream side, is arranged on the most upstream portion in the suction passage 11*a* that is located immediately after the inlet pipe 56, and communicates with the fuel storage chamber 25 from the inner chamber section 52*a* on the one side via the inner chamber section 52*b* on the other side and the communication hole 41*h* on the upper side in the vertical direction. Accordingly, in conjunction with the elevation of the liquid surface of the fuel in the fuel introducing chamber 55, the fuel vapor in the fuel introducing chamber 55 moves to the fuel storage chamber 25 side through the communication hole 41*h* on the upper side.

Furthermore, the inside flange shaped portion 53*b* of the partition wall member 53 extends downward in the vertical direction with respect to the communication hole 41*h* by the specified projected height that corresponds to the height hp of the set liquid surface. Thus, even when the fuel vapor is pooled in an upper portion of the inner chamber section 52*b* on the other side, the fuel vapor is less likely to flow into the fuel introducing chamber 55 side. Therefore, a large quantity of the fuel vapor does not flow into the fuel pressurizing chamber 13 when the supply of the high-pressure fuel is restarted (when the pressurization is started).

Accordingly, even in a high-temperature environment such as the high-temperature soak state, the fuel at the relatively low temperature that is supplied from the feed pump can immediately be suctioned into the fuel pressurizing chamber 13 when the supply of the high-pressure fuel is restarted. Consequently, responsiveness of the high-pressure fuel pump 10 to the pressurization and discharge upon start of supply of the high-pressure fuel is started can be increased.

When the pressure-feeding and supply of the fuel from the feed pump are started in a state that the fuel is boiled and vaporized to such a degree that the liquid-state fuel that contacts the suction valve body 42 is hardly present, the fuel that is immediately after being supplied and introduced into the fuel introducing chamber 55 forms the initial fuel pool 57*b* that is in a degree indicated by cross-hatching, that has the higher liquid surface height than the projected height hs of the suction valve seat 43, and that is at least on the upstream side of the suction valve body 42 in the inner chamber section 52*a* on the one side. Then, the initial fuel pool 57*a* on the downstream side of the suction valve seat 43 is further formed in the valve opened state of the suction valve unit 14, and the liquid surface height on the downstream side of the inside flange shaped portion 53*b* of the partition wall member 53 is further increased. Consequently, the initial fuel pool 57 in which the initial fuel pools 57*a*, 57*b* are integrated is formed.

During this time, once the liquid surface height of the initial fuel pool 57*a* on the downstream side of the suction valve seat 43 becomes high enough that the fuel can be suctioned to the fuel pressurizing chamber 13 side, the fuel that is immediately after being supplied flows into the fuel pressurizing chamber 13 side. Here, even in the valve opened state of the suction valve unit 14, the pressure in the fuel pressurizing chamber 13 is lowered when the plunger 12 moves downward. Thus, at this time, the liquid surface height at which the fuel can flow into the fuel pressurizing chamber 13 is slightly lower than the height hi at which the fuel can naturally flow into the fuel pressurizing chamber 13.

Accordingly, in this embodiment, in order to improve the responsiveness to the pressurization of the fuel and the discharge of the high-pressure fuel in the high-temperature environment, the fuel introducing chamber 55 with the small volume is formed in the inner chamber section 52*a* on the one side so that a time required for the fuel (liquid) in the inner chamber section 52*a* on the one side to reach the liquid surface height at which the fuel can flow into the inner side of the suction valve seat 43 is shortened.

In this embodiment, unlike a conventional fuel pump, there is no need to provide a heat insulating material or a cooling part to avoid pressurization failure, or there is no need to increase the fuel pressure in the low-pressure fuel circuit. Thus, manufacturing cost of the high-pressure fuel pump 10 and a high-pressure fuel supply system that uses the high-pressure fuel pump 10 can be reduced.

In this embodiment, the attachment hole 22*a* of the upper housing member 22, the cylindrical member 41, and the like are provided as the cylindrical member that forms the suction valve chamber 51, and the fuel introducing chamber 55 is arranged on the inner circumference thereof. Thus, while the suction valve chamber 51 and the fuel storage chamber 25 are divided from each other, the fuel introducing chamber 55 with the small volume that is adjacent to the upstream side of the suction valve body 42 can easily be formed.

Since the communication hole 41*h* that allows the inner chamber section 52*b* on the other side in the suction valve chamber 51 to communicate with the fuel storage chamber 25 is formed on the upper side in the vertical direction of the cylindrical member 41, the fuel in the liquid state that is immediately being supplied is filled in the fuel introducing chamber 55, and is then filled in the entire suction valve chamber 51. Thereafter, the supplied fuel flows into the fuel storage chamber 25. Thus, even when the vaporization of the fuel is progressed in the fuel storage chamber 25, the high-pressure fuel can immediately be discharged without being influenced by the vaporization.

In this embodiment, since the fuel introducing chamber 55 is arranged on the upstream side portion of the inner chamber section 52*a* on the one side in the cylindrical member 41 and the like, the fuel introducing chamber 55 with the extremely small volume that is directly connected to the suction valve chamber 51 can easily be formed. Thus, the responsiveness to the pressurization and discharge of the high-pressure fuel pump 10 upon the start of the engine and the like in the high-temperature environment can further be improved.

In this embodiment, since the partition wall member 53 has the inside flange shaped portion 53*b*, the suction valve unit 14 in which the suction valve body 42, the solenoid plunger 46, the compression coil spring 48, and the like are arranged in the cylindrical member 41 and the like can easily be configured, and the fuel introducing chamber 55 with the small volume can easily be formed in the suction valve unit 14.

In this embodiment, the suction valve seat 43 that the suction valve body 42 can be engaged and detached, the partition wall member 53, and the one end 41*a* of the cylindrical member 41 are coaxially joined to each other with respect to the attachment hole 22*a* of the upper housing member 22. Thus, the suction valve seat 43, the partition wall member 53, and the cylindrical member 41 can easily be joined in this order to the attachment hole 22*a* of the upper housing member 22, and the fuel introducing chamber 55 can easily be defined by the joining.

As described above, in this embodiment, it is possible to provide the low-cost high-pressure fuel pump 10 that has the excellent responsiveness to allow immediately pressurization and discharge of the fuel even when the supply of the high-pressure fuel is started in the high-temperature environment.

Figure 5:
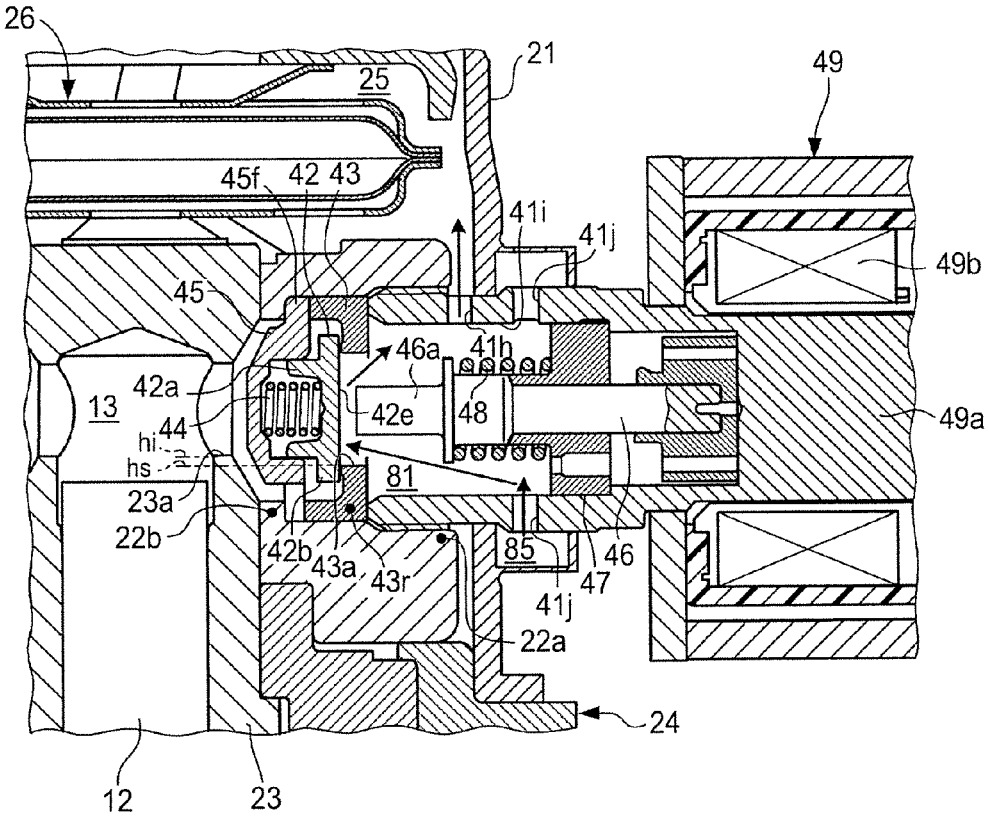
FIG. 5 is a partially enlarged cross-sectional view of the vicinity of a suction valve that illustrates a high-pressure fuel pump in a comparative example.
Figure 6:
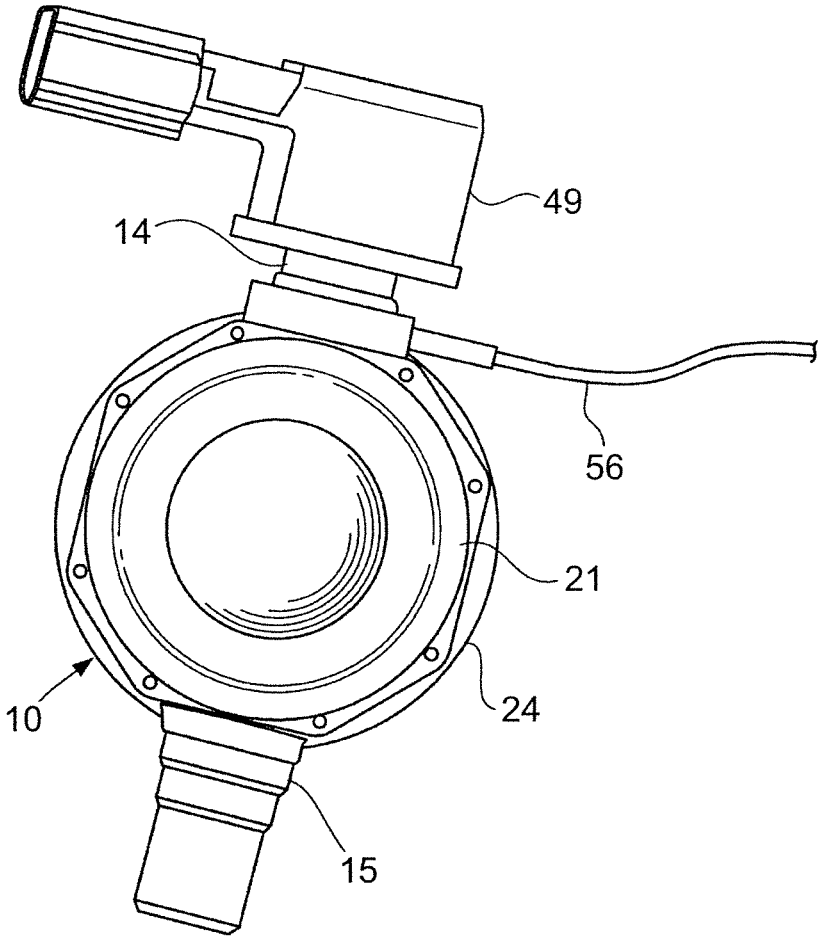
FIG. 6 is a top view of the high-pressure fuel pump in the comparative example.
Figure 7:
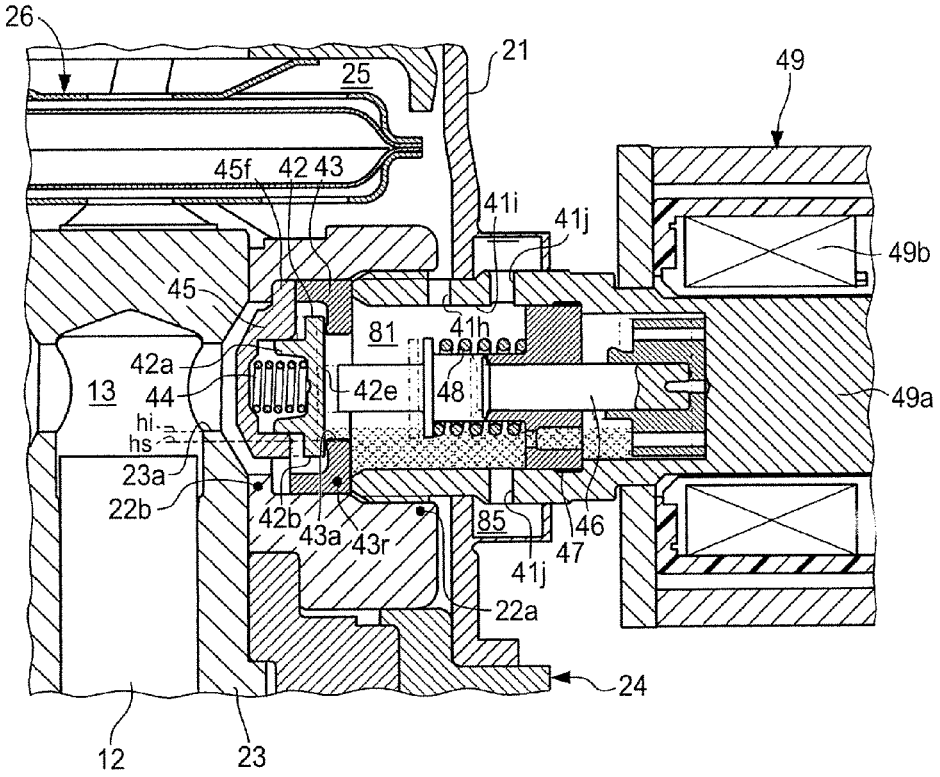
FIG. 7 is a partially enlarged cross-sectional view of the vicinity of a suction valve that illustrates an operation of the high-pressure fuel pump in the comparative example.

(Comparative Example) FIG. 5 to FIG. 7 show a high-pressure fuel pump of a comparative example that is partly similar to the high-pressure fuel pump in the above embodiment.

It should be noted that, although the high-pressure pump described below differs from the high-pressure pump in the above-described embodiment in terms of a configuration in the vicinity of the fuel introducing chamber, the other configuration thereof is substantially the same as that of the high-pressure pump in the above-described embodiment. Accordingly, the same reference numerals that correspond to those in the embodiment shown in FIG. 1 to FIG. 4 are used for the same configuration as that of the embodiment. A description will hereinafter be made particularly on points that differ from the embodiment.

In a high-pressure fuel pump 60 of this comparative example, the attachment hole 22*a* of the upper housing member 22 and the cylindrical member 41 (hereinafter simply referred to as the cylindrical member 41 and the like) are provided as the cylindrical member that forms a suction valve chamber 81 with a small volume therein. The spring receiver 45, the suction valve body 42, the suction valve seat 43, the valve spring 44 that urges the suction valve body 42 to the one side and the other side in the opened/closed direction, and the solenoid plunger 46 are housed in this order from the inner back side in the cylindrical member 41 and the like. Thus, the suction valve chamber 81 in this example is adjacent to the upstream side of the suction valve body 42.

On the outer circumferential side of the cylindrical member 41, an outside fuel introducing chamber 85 that directly introduces fuel supplied from the feed pump through the inlet pipe 56 is formed in an annular shape, so as to be directly connected to the suction valve chamber 81.

The cylindrical member 41 is formed with plural communication holes 41*j* in a radiation direction that allow the suction valve chamber 81 to communicate with the outside fuel introducing chamber 85. The suction valve chamber 81 and the outside fuel introducing chamber 85 are substantially integrated to form a fuel introducing chamber with a relatively small volume that is adjacent to the upstream side of the suction valve body 42.

On the contrary, the communication hole 41*h* that allows the suction valve chamber 81 to communicate with the fuel storage chamber 25 is only formed on the upper side in the vertical direction of the cylindrical member 41. A passage cross-sectional area of the communication hole 41*h* that is opened in the vertical direction of the suction valve chamber 81 is smaller than an opening area (a passage cross-sectional area) of each of the plural communication holes 41*j* in the radiation direction that are opened to the suction valve chamber 81.

In the high-pressure fuel pump 60 of this comparative example, when the pressure-feeding and supply of the fuel from the feed pump are started due to the restart of the engine or the like in the high-temperature environment, first, the fuel that is directly introduced into the outside fuel introducing chamber 85 with the small volume through the inlet pipe 56 is introduced into the suction valve chamber 81 that is substantially integrated with the outside fuel introducing chamber 85 through the plural communication holes 41*j* in the radiation direction.

At this time, if the vaporization of the fuel is progressed in the fuel storage chamber 25 and the suction valve chamber 81, and a large quantity of the fuel vapor is produced in the suction valve chamber 81, a liquid surface of the liquid fuel at a relatively low temperature that is introduced from the outside fuel introducing chamber 85 to the suction valve chamber 81 increases its height. Once this liquid surface becomes equal to or higher than the height hi that is slightly higher than a liquid surface at which the fuel can flow to the inside of the suction valve seat 43, the fuel that is immediately after being supplied can flow into the fuel pressurizing chamber 13.

Then, upon the valve opening that the suction valve body 42 separates from the suction valve seat 43, the fuel that is immediately after being supplied, enters the suction valve chamber 81 from the outside fuel introducing chamber 85, and is introduced to the inside of the suction valve seat 43 reliably flows into the fuel pressurizing chamber 13 before flowing into the fuel storage chamber 25 with the large volume.

Thus, at this time, if the high-temperature soak state is continued, and the quantity of the fuel vapor in the fuel storage chamber 25 is increased, the fuel vapor remains on the upper side in the vertical direction of the suction valve chamber 81. In such a state, the fuel that enters the suction valve chamber 81 from the outside fuel introducing chamber 85 and is pooled in a lower side in the vertical direction of the suction valve chamber 81 flows into pressurizing chamber 13 while increasing its liquid surface height to be located on the upper side of the projected height hs in the particular direction of the suction valve seat 43. Thus, even if the quantity of the fuel vapor is increased in the fuel storage chamber 25, this has no influence, and a large quantity of the fuel vapor does not flow into the fuel pressurizing chamber 13 even when the supply of the high-pressure fuel is restarted.

However, some quantity of the fuel vapor can be suctioned in the fuel pressurizing chamber 13 until the fuel vapor that remains on the upper side in the vertical direction of the suction valve chamber 81 moves to the fuel storage chamber 25 side when the supply of the high-pressure fuel is restarted. Thus, the above-described embodiment is preferred.

Here, when the pressure-feeding and supply of the fuel from the feed pump are started in a state that the fuel is boiled and vaporized to such a degree that the liquid-state fuel that contacts the suction valve body 42 is hardly present, the fuel that is immediately after being supplied and that is introduced into the outside fuel introducing chamber 85 is pooled in a degree that is indicated by cross-hatching in FIG. 7 in an intermediate inner chamber section 85b. Once the liquid surface height of the fuel becomes high enough to allow the fuel to flow to the inside of the suction valve seat 43, the fuel that is immediately after being supplied flows into the fuel pressurizing chamber 13.

Thus, also in this comparative example, even in the high-temperature environment like the high-temperature soak state, the fuel at the relatively low temperature that is supplied from the feed pump can be suctioned into the fuel pressurizing chamber 13 relatively immediately when the supply of the high-pressure fuel is restarted.

In addition, in this comparative example, while the suction valve chamber 81 and the fuel storage chamber 25 are divided by the cylindrical member 41, the outside fuel introducing chamber 85 can easily be formed on the upstream side of the suction valve chamber 81. Thus, connection of the inlet pipe and the like can be simplified.

Figure 8:
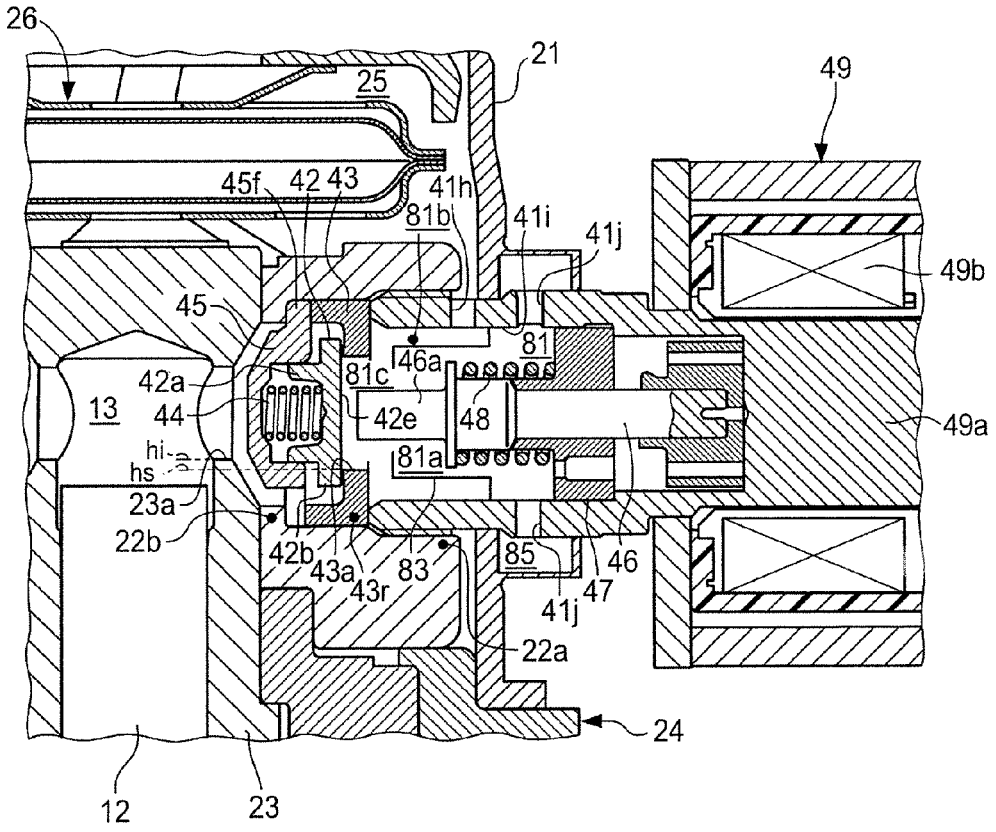
FIG. 8 is a partially enlarged cross-sectional view of the vicinity of a suction valve of a high-pressure fuel pump in another comparative example.

(Another Comparative Example) FIG. 8 shows a high-pressure fuel pump of another comparative example.

The high-pressure fuel pump 60 of this comparative example is provided with a cylindrical partition wall member 83 with a flange on the inside of the cylindrical member 41, in addition to the configuration of the comparative example described above.

This cylindrical partition wall member 83 with the flange divides the suction valve chamber 81 on the inside of the cylindrical member 41 into an inner chamber section 81*a* on the upstream side, an inner chamber section 81*b* on the downstream side, and an intermediate inner chamber section 81*c*.

More specifically, in this comparative example, the cylindrical partition wall member 83 with the flange that is fixed and supported on the inside of the cylindrical member 41 divides the suction valve chamber 81 into the inner chamber section 81*a* on the upstream side that communicates with the outside fuel introducing chamber 85 through the plural communication holes 41*j* in the radiation direction that are formed in the cylindrical member 41, the inner chamber section 81*b* on the downstream side that communicates with the fuel storage chamber 25 through the communication hole 41*h*, and the intermediate the inner chamber section 81*c* that faces the pressure receiving surface 42*e* of the suction valve body 42 on the upstream side. In other words, a cylindrical folded fuel passage that enters the inner chamber section 81*a* on the upstream side from the outside fuel introducing chamber 85, is folded from radial inside to radial outside in the intermediate inner chamber section 81*c*, and reaches the fuel storage chamber 25 from the inner chamber section 81*b* on the downstream side is formed in the suction valve chamber 81.

Then, the fuel that is immediately being supplied from the feed pump can be introduced from the outside fuel introducing chamber 85 to the vicinity of the pressure receiving surface 42*e* of the suction valve body 42 on the upstream side through the inner chamber section 81*a* on the upstream side of the suction valve chamber 81. Thus, the fuel that is immediately being supplied can flow into the fuel pressurizing chamber 13 without flowing through the fuel storage chamber 25.

Furthermore, in this comparative example, the cylindrical partition wall member 83 with the flange that divides the suction valve chamber 81 into the inner chamber section 81*a* on the upstream side, the inner chamber section 81*b* on the downstream side, and the intermediate inner chamber section 81*c* is formed on the inside of the cylindrical member 41. Thus, the intermediate inner chamber section 81*c* with a small volume that faces the pressure receiving surface 42*e* on the upstream side of the suction valve body 42 can be formed, and the outside fuel introducing chamber 85 is directly connected thereto. Accordingly, the fuel supplied from the feed pump directly flows into the fuel pressurizing chamber 13. Therefore, the responsiveness to the pressurization and discharge of the high-pressure fuel pump 60 can be improved.

However, some quantity of the fuel vapor can be suctioned in the fuel pressurizing chamber 13 until the fuel vapor that remains on the upper side in the vertical direction of the suction valve chamber 81 moves to the fuel storage chamber 25 side when the supply of the high-pressure fuel is restarted. Thus, the above-described embodiment is preferred.

Here, in the above-described embodiment, a low-pressure fuel pipe such as the inlet pipe 56 is directly connected to a member that forms the fuel introducing chamber 55. However, in the present invention, a short low-pressure fuel passage immediately before the fuel introducing chamber may be formed by perforation in a component that constitutes the high-pressure fuel pump 10.

Furthermore, needless to say, the suction valve body is not limited to the substantially disc-shaped suction valve body such as the suction valve body 42 described above, and the suction valve seat 43 may be provided integrally with the cylindrical member 41 and the like.

The plunger 12 may have a piston shape, whose tip that defines the fuel pressurizing chamber 13 has an enlarged diameter. In this case, an auxiliary chamber on the outer end side of the piston-shaped pressurizing member may communicate with the fuel storage chamber 25. In addition, a pulsation absorbing element such as the pulsation damper 26 may not be housed in the fuel storage chamber 25. The vertical direction described above is an up-adown direction that is the same as the axial direction of the plunger 12 in the drawings. Meanwhile, the vertical direction of the present invention is also the vertical direction in a mounted posture (installed posture) of the high-pressure fuel pump to the engine.

As it has been described so far, the present invention can provide the low-cost high-pressure fuel pump with the excellent responsiveness to allow immediately pressurization and discharge of the fuel even when the supply of the high-pressure fuel is started in the high-temperature environment. The present invention like this is useful for the high-pressure fuel pump in general that forms the fuel pool on the suction side of the fuel pressurizing chamber.

What is claimed is:

1. A high-pressure fuel pump comprising:

a pump housing including a fuel passage;

a pressurizing member operably supported by the pump housing, so as to define a fuel pressurizing chamber for communicating with the fuel passage in the pump housing, the pressurizing member configured to be displaced in a suction operation direction in which fuel is suctioned into the fuel pressurizing chamber and in a discharge operation direction in which the fuel in the fuel pressurizing chamber is discharged;

a suction valve seat provided on a suction side of the fuel pressurizing chamber within the fuel passage, the suction valve seat including a first projected wall section that is projected towards an upper side in a vertical direction;

a suction valve body configured to engage with and disengage from the suction valve seat, so as to switch between a valve opened state in which a suction operation of the fuel into the fuel pressurizing chamber is permitted and a valve closed state in which a backflow of the fuel from the fuel pressurizing chamber to an upstream side of the suction valve seat is prevented; and a suction valve chamber that houses the suction valve body on the suction side of the fuel pressurizing chamber within the fuel passage, wherein the pump housing includes a second projected wall section that is projected towards the upper side in the vertical direction and provided inside of the suction valve chamber, the second projected wall section defines an opening, a height from a lowest position in a portion of the second projected wall section that is projected towards the upper side in the vertical direction is higher than a height from a lowest position in a portion of the first projected wall section that is projected towards the upper side in the vertical direction, a fuel introducing chamber is provided between the second projected wall section and the suction valve seat and adjacent to the upstream side of the suction valve seat, the fuel from outside of the pump housing is configured to be directly introduced into the fuel introducing chamber, the fuel introducing chamber, the first projected wall section and the second projected wall section provide a first initial fuel pool that stores the fuel when the fuel from the outside is introduced into the fuel introducing chamber and the suction valve body is in the valve closed state, and the first initial fuel pool is provided on a downstream side of the second projected wall section and on the upstream side of the suction valve seat.

2. The high-pressure fuel pump according to claim 1, wherein the fuel passage and the suction valve seat provide a second initial fuel pool that stores the fuel when the fuel from the outside is introduced into the fuel introducing chamber, the second initial fuel pool is provided on the downstream side of the suction valve seat in a portion of the fuel passage on the suction side.

3. The high-pressure fuel pump according to claim 1, wherein the fuel pressurizing chamber includes a suction port provided on the suction side of the fuel pressurizing chamber within the fuel passage, the suction port is provided on the downstream side of the suction valve seat, a height of an opening inner circumferential surface of the suction port on the upper side in the vertical direction is set between the height of the first projected wall section and the height of the second projected wall section, and the height of the opening inner circumferential surface is closer to the height of the first projected wall section than the height of the second projected wall section.

4. The high-pressure fuel pump according claim 1 further comprising:

an elastic member configured to urge the suction valve body to one of the closing direction and the opening direction, the elastic member housed in the suction valve chamber;

a rod-shaped valve body operating member configured to urge the suction valve body to the other of the closing direction and the opening direction, the rod-shaped valve body operating member housed in the suction valve chamber, wherein the second projected wall section is a flange that extends inwardly to define the opening, and the flange surrounds a shaft portion of the rod-shaped valve body operating member on the suction valve body side.

5. The high-pressure fuel pump according to claim 4 wherein the suction valve chamber includes a cylindrical member that is fixed on the pump housing, the second projected wall section partitions the inside of the cylindrical member into a first inner chamber section on one side of the second projected wall section and a second inner chamber section on the other side of the second projected wall section, and the first inner chamber section houses the suction valve body and the fuel introducing chamber is arranged in the first inner chamber section.

6. The high-pressure fuel pump according to claim 5 wherein the pump housing includes a fuel storage chamber for storing the fuel, and the cylindrical member includes a communication hole that communicates between the fuel storage chamber and the second inner chamber section on the upper side in the vertical direction.

7. The high-pressure fuel pump according to claim 5 wherein the pump housing includes a cylinder member that slidably holds the pressurizing member and a holder member that holds the cylindrical member, the holder member coaxially joins the suction valve seat, a partition wall, and one end of the cylindrical member, the partition wall includes the second projected wall section.

8. The high-pressure fuel pump according to claim 2, wherein the fuel pressurizing chamber includes a suction port provided on the suction side of the fuel pressurizing chamber within the fuel passage, the suction port is provided on the downstream side of the suction valve seat, a height of an opening inner circumferential surface of the suction port on the upper side in the vertical direction is set between the height of the first projected wall section the height of the second projected wall section, and the height of the opening inner circumferential surface is closer to the height of the first projected wall section than the height of the second projected wall section.

9. The high-pressure fuel pump according to claim 2 further comprising:

an elastic member configured to urge the suction valve body to one of the closing direction and the opening direction, the elastic member housed in the suction valve chamber;

a rod-shaped valve body operating member configured to urge the suction valve body to the other of the closing direction and the opening direction, the rod-shaped valve body operating member housed in the suction valve chamber, wherein the second projected wall section is a flange that extends inwardly to define the opening, and the flange surrounds a shaft portion of the rod-shaped valve body operating member on the suction valve body side.

10. The high-pressure fuel pump according to claim 3 further comprising:

an elastic member configured to urge the suction valve body to one of the closing direction and the opening direction, the elastic member housed in the suction valve chamber;

a rod-shaped valve body operating member configured to urge the suction valve body to the other of the closing direction and the opening direction, the rod-shaped valve body operating member housed in the suction valve chamber, wherein the second projected wall section is a flange that extends inwardly to define the opening, and the flange surrounds a shaft portion of the rod-shaped valve body operating member on the suction valve body side.

11. The high-pressure fuel pump according to claim 8 further comprising:

an elastic member configured to urge the suction valve body to one of the closing direction and the opening direction, the elastic member housed in the suction valve chamber;

a rod-shaped valve body operating member configured to urge the suction valve body to the other of the closing direction and the opening direction, the rod-shaped valve body operating member housed in the suction valve chamber, wherein the second projected wall section is a flange that extends inwardly to define the opening, and the flange surrounds a shaft portion of the rod-shaped valve body operating member on the suction valve body side.

12. The high-pressure fuel pump according to claim 6 wherein the pump housing includes a cylinder member that slidably holds the pressurizing member and a holder member that holds the cylindrical member, the holder member coaxially joins the suction valve seat, a partition wall, and one end of the cylindrical member, the partition wall includes the second projected wall section.

* * * * *